US007917998B2

(12) United States Patent
Peters

(10) Patent No.: US 7,917,998 B2
(45) Date of Patent: Apr. 5, 2011

(54) METHOD AND DEVICE FOR THE CONTINUOUS CUTTING OF FIBERS

(75) Inventor: Herbert Peters, Neumunster (DE)

(73) Assignee: Oerlikon Textile GmbH & Co. KG (DE)

( * ) Notice: Subject to any disclaimer, the term of this patent is extended or adjusted under 35 U.S.C. 154(b) by 247 days.

(21) Appl. No.: 12/416,466

(22) Filed: Apr. 1, 2009

(65) Prior Publication Data

US 2009/0260190 A1 Oct. 22, 2009

(30) Foreign Application Priority Data

Apr. 18, 2008 (DE) ..... 10 2008 019 584

(51) Int. Cl.
*D01G 1/00* (2006.01)

(52) U.S. Cl. ..... 19/0.6

(58) Field of Classification Search ..... 19/0.3, 19/0.58, 0.6; 83/331, 337, 338, 340–343, 83/336, 673–675
See application file for complete search history.

(56) References Cited

U.S. PATENT DOCUMENTS

| | | | | | |
|---|---|---|---|---|---|
| 3,744,361 | A * | 7/1973 | Van Doorn et al. | ..... | 83/37 |
| 3,826,163 | A * | 7/1974 | Spaller et al. | ..... | 83/18 |
| 3,831,481 | A * | 8/1974 | Van Doorn et al. | ..... | 83/674 |
| 3,915,042 | A * | 10/1975 | Laird | ..... | 83/341 |
| 4,141,115 | A * | 2/1979 | Fourne et al. | ..... | 19/0.6 |
| 4,345,355 | A * | 8/1982 | Berchoux et al. | ..... | 19/0.6 |
| 4,391,169 | A * | 7/1983 | Laird et al. | ..... | 83/37 |
| 4,528,050 | A * | 7/1985 | Arther et al. | ..... | 156/62.4 |
| 4,548,106 | A * | 10/1985 | Fleissner | ..... | 83/18 |
| 4,924,554 | A * | 5/1990 | Stolarski et al. | ..... | 19/0.6 |
| 2008/0072724 | A1 * | 3/2008 | Ishibuchi et al. | ..... | 83/342 |

* cited by examiner

*Primary Examiner* — Shaun R Hurley
(74) *Attorney, Agent, or Firm* — BainwoodHuang

(57) ABSTRACT

A method and a cutting device for the continuous cutting of fibers fed in fiber cables into fiber sections of particularly short length is disclosed. In order to avoid high friction forces between the formed knives and the fiber sections, and furthermore, to prevent excessive deforming of the fiber section during the transport between the knives, the knives are arranged at an offset to each other such that the fibers are initially cut into longer fiber sections, and into shorter fiber sections in a second step. The respective free space between the knives is increased due to the offset arrangement of the knives.

14 Claims, 5 Drawing Sheets

METHOD AND DEVICE FOR THE CONTINUOUS CUTTING OF FIBERS

FIELD OF THE INVENTION

Embodiments of the invention relate to a method for the continuous cutting of fibers, and a cutting device for carrying out the method.

Along these lines, a generic method and a generic device for the continuous cutting of fibers are utilized in order to cut continuously converging endless fibers into short sections. In order to avoid oscillating movements the running fiber is guided across a wheel rotating at a circumferential speed corresponding to the fiber speed, wherein the wheel has a plurality of knives at the contact surface, wherein the blades of the knives are directed opposite of the fiber and are aligned in the direction of the desired cut. A press-on element presses the fiber against the blades of the knives such that the fibers are cut.

BACKGROUND

It is known from the printed publication DE 216 00 79 to arrange the knives on the outer circumference in axial direction, wherein the blades are aligned in the radial cutting direction. The fibers to be cut are guided around the wheel, wherein circumferential collars guide the fibers in axial direction. In this case the press-on element is embodied as a second wheel, the outer circumference of which rolls off the blades of the knives, thus pressing the fiber against the blades. The cut fiber sections can be pressed through channels provided between the knives, and are collected and discharged in the direction of a collection chamber arranged in the interior of the wheel in this manner.

As an alternative it is known from the printed publication DE 102 42 553 to arrange the knives radially with the blades being aligned in axial cutting direction such that the fibers are pressed against the blades of the knives in axial direction and the fiber sections are pressed through between the knives by means of channels that are aligned in axial direction.

SUMMARY

However, regardless of the arrangement of the knives, it has been shown that the generic method and the cutting device are not suitable for cutting short fiber sections at a high cutting performance. The length of the fiber sections is determined by the distance of the knives to one another, wherein a relatively short distance of the knives, and therefore short fiber sections, result in a higher cutting resistance and lower cutting performances. In this manner a cutting length of 3 mm, for example, could be achieved only at a significantly reduced cutting performance as opposed to a cutting length of 4 millimeters. The lower cutting performances have the effect of reduced fiber speeds of the fiber cable, and thus an adverse effect on the fiber street arranged in front of the same so that it becomes necessary to separate the fiber cable into two strands that are cut on separate cutting devices. In addition to the higher investment costs for the cutting devices therefore, a higher susceptibility to failure is also associated due to the separating of the fiber cable.

Another problem with the cutting of short fiber sections is that the same must be fed through the channel, which is formed between two adjacent knives. However, since the knives may not be embodied at any desired thin dimensions for larger yarn counts, the channels become disproportionately narrower with a decreasing cutting length. In short fiber sections this leads to face that the same are permanently deformed during the transport through two knives. Furthermore, high forces are exerted, which adversely affect the cutting performance. Such deformed fiber sections are unacceptable in many applications, and can be avoided only by means of discontinuous cutting operations.

It is therefore the object of the invention to eliminate said disadvantages of the generic method and of the generic device, and to provide a method and a device for the continuous cutting of fibers into short sections.

This object is solved by means of a method for the continuous cutting of fibers fed in the form of a fiber cable into fiber sections. The fiber cable is continuously fed to a cutting device, wherein the cutting device has a plurality of blades having a continuous movement. The fibers are initially separated into longer fiber sections by the cutting device. The longer fiber sections are then separated into shorter fiber sections by the same cutting device.

Additionally, this object is solved by means of a cutting device for carrying out the method. The cutting device has a rotationally driven knife carrier which includes a plurality of knives, having a channel that is connected to the knife carrier, which is penetrated by the knives, having a press-on element (or press-on means) for pressing the fiber cable onto the blades of the knives in a press-on direction. The knives are arranged in at least two groups, wherein the blades of the knives of the first group have a smaller distance to the press-on element in the press-on direction, than the blades of the knives of the second group.

The invention is based on the knowledge that in case of short fiber sections a significant amount of the press-on force to be exerted in the cutting direction must be applied in order to convey the fiber sections through the channel between the knives. The invention departs from the known principle and pursues a completely novel manner, wherein the fibers are initially cut into fiber sections in a first step, which have a larger length. In a subsequent second step said fiber sections are then separated into shorter fiber sections having a smaller length by means of the same knife carriers.

The advantage of the invention is that the fed fiber cable can be cut at greater distances between the knives such that the fiber cable can be fed at relatively high fiber speeds. In this manner the problems caused by the narrow distance between the knives can be avoided during the cutting of the fibers. After the first cut the fiber sections are separated by means of a subsequent cut in order to obtain the desired short fiber sections. For this purpose the distance of the blades required for the second step may also be arranged in a larger manner, thus also within a noncritical range.

In order to be able to create fiber sections that are as short as possible, the method variation is preferably utilized, wherein the fiber sections are created by means of multiple groups of knives with blades being arranged at an offset to each other. In this manner fiber sections may also be separated multiple times, wherein the cuts are preferably carried out in a successive manner.

During the cutting of the fiber cable into first fiber sections care should be taken that no lateral forces are generated at the blades of the knives, and that the movement of the blades is adjusted to the feed speed of the fiber cable. For this purpose the fiber cable is preferably fed at a partial loop of a first group of knives with blades and separated into the longer fibers sections by means of pressing the same on.

In order for the longer fiber sections to all be evenly cut, the fiber sections are each guided between adjacent blades of the first group along the knives to the blades of the next group of knives with blades, and are cut.

The final short fiber sections at a target length are directly discharged after the last cut between the knives of the last group. In this manner a continuous material flow can be realized in the press-on direction such that each cut can be carried out on the fibers at the same press-on conditions.

A device for carrying out the method according to the invention has a knife carrier, including a channel for conveying the fiber sections and knives penetrating said channel, wherein the knives are arranged in two groups. The first group of the knives is positioned closer to the fiber cable to be cut in the press-on direction such that the fibers are first pressed against the blades of said knives by the press-on element, and are then cut. A second group of the knives is arranged behind the same and carries out the second cut on the fiber sections.

Preferably the knives of the first and of the second groups are arranged successively. In this manner the distance between the knives is twice as large as the length of the fiber sections to be created. The press-on element presses the fibers of the fiber cable directly against the blades of the first knife group. The long fiber sections are continuously conveyed through the channel and pressed against the blades of the second knife group by means of additional subsequently cut fiber sections, which place themselves on top.

For this purpose the fiber sections may be separated via one blade or multiple blades such that one or multiple knives of the second group are arranged on the knife carrier between two adjacent knives of the first group.

Advantageously the knives of the second group are offset toward the back by a height offset that is at least half of a depth of the knives in the first group. Although a slight friction of the fiber sections cut to the final length between the knives of the first and of the second group may not be avoided in this manner, the friction forces can be significantly reduced. Furthermore, the effect of the fiber sections cut by the first knife group are conveyed through the channel directly after the cut, rubbing against the knives, thus experiencing a bending, but are then bent in the opposite direction during the cut made by the second knife group.

In a particularly advantageous embodiment of the cutting device according to the invention the height offset between the first knife group and the second knife group is so large that the blades of the second knife group are located completely behind the knives of the first knife group. In this case the depth of the knives of the first group is equally large as the height offset between the knives of both groups. In this manner friction forces occurring due to fiber sections rubbing between the knives of the first and second groups is avoided. Another substantial advantage of said embodiment is that relatively broad channel openings can be formed between the knives of the second group for discharging the fiber sections.

In a variation of the cutting device according to the invention the knives of the wheel-shaped knife carrier are arranged axially parallel at the outer circumference, having a blade facing toward the outside, wherein the press-on direction is directed radially toward the inside. This corresponds to a figuration according to the invention of the embodiment of cutting devices, which radially cut the fiber cable in the direction of the loop, as is described, for example, in the printed publication DE 216 00 79.

In another variation of the cutting device according to the invention the knives in turn are aligned radially with the blade facing in axial direction, having an axial press-on direction. This corresponds to a figuration according to the invention of the embodiment of cutting devices, which axially cut the fiber cable laterally to the direction of the loop, as is described, for example, in the printed publication DE 102 42 553.

BRIEF DESCRIPTION OF THE DRAWINGS

Some example embodiments of the cutting device according to the invention for carrying out the method according to the invention are described in further detail below, with reference to the attached drawings.

They show.

DETAILED DESCRIPTION

Figure 1:
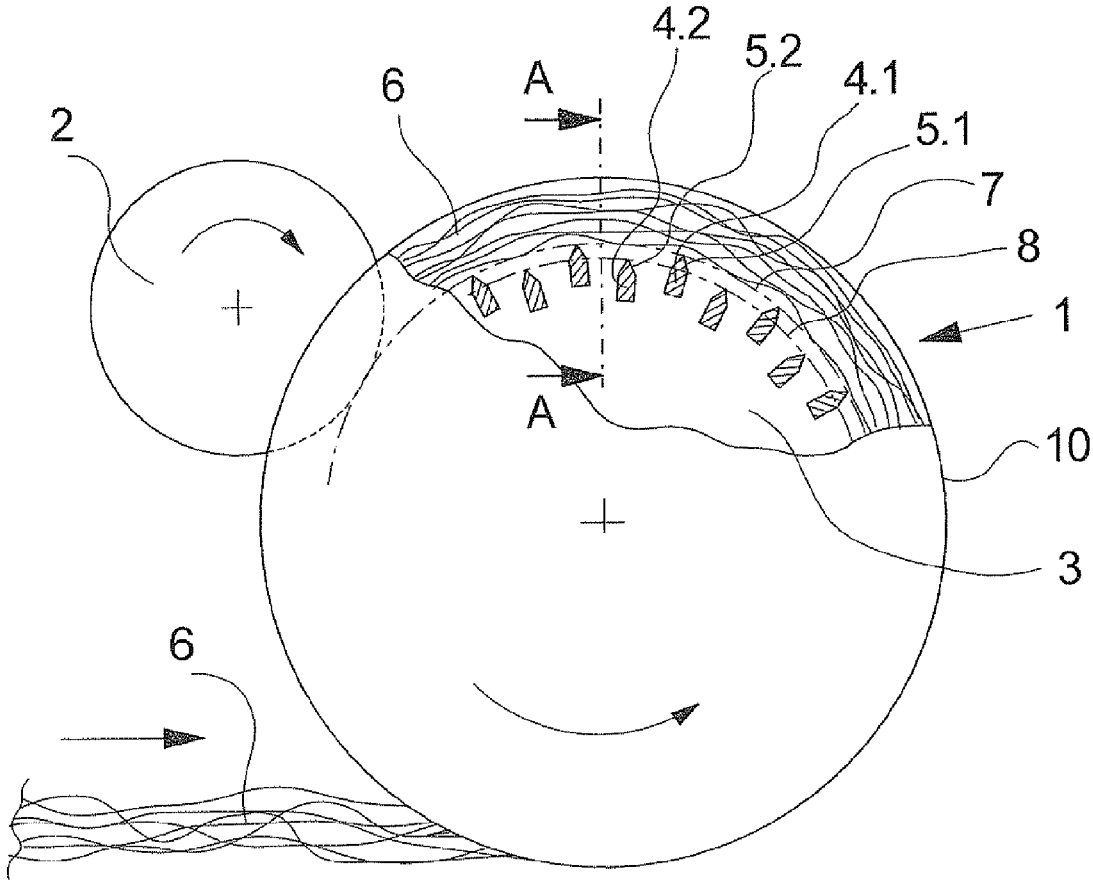
FIG. 1: a schematic view of a first example embodiment of the cutting device according to the invention for carrying out the method according to the invention.
Figure 2:
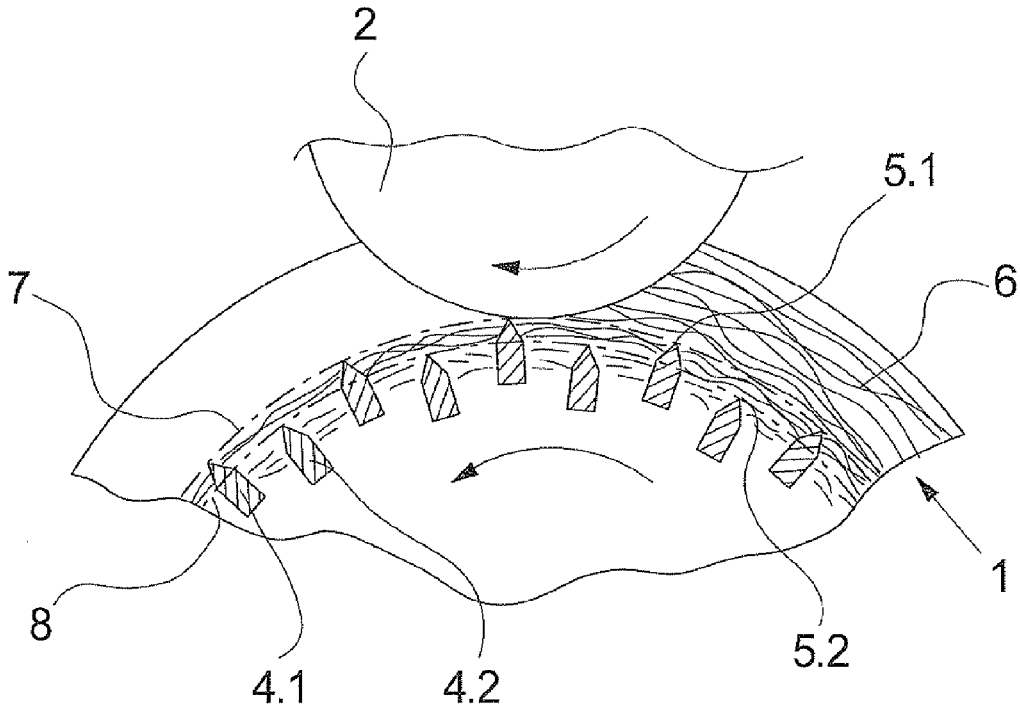
FIG. 2: a schematic view of the example embodiment of FIG. 1 for illustrating the cutting process.
Figure 3:
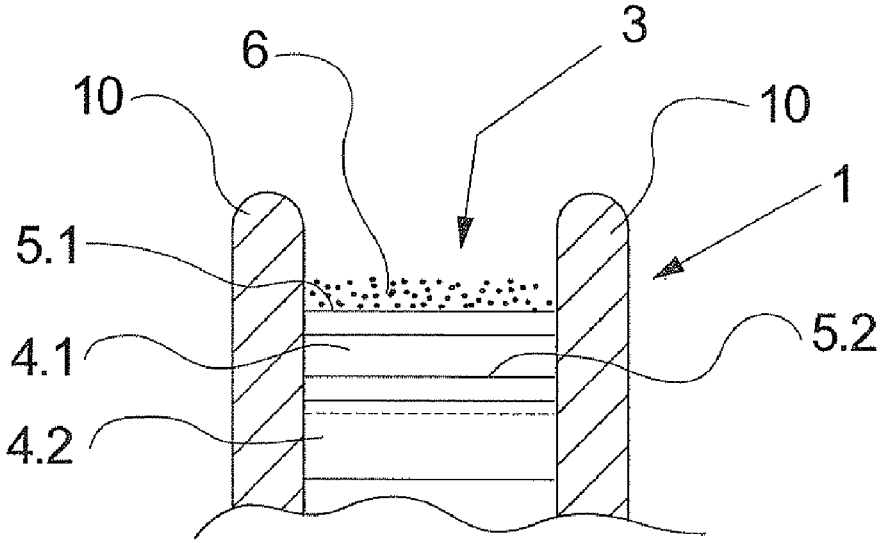
FIG. 3: a schematic cross-sectional view of the example embodiment of FIG. 1 at a cross-section A-A of FIG. 1, FIG. 4: a schematic view of another example embodiment of the cutting device according to the invention for carrying out the method according to the invention.

FIG. 1 illustrates a first example embodiment of a cutting device according to the invention for carrying out the method according to the invention. FIG. 2 shows the cutting device of FIG. 1 as a detailed illustration in the contact area between a knife carrier 1 and a press-on element 2. FIG. 3 illustrates a cross-sectional view of the example embodiment at a cross-section A-A of FIG. 1. The following description applies to all figures insofar as no express reference is made to one of the figures.

The example embodiment of the cutting device consists of a rotating knife carrier 1, which interacts with a press-on element 2. The fibers in the form of a fiber cable 6 are continuously fed to the cutting device for cutting the fiber sections. The knife carrier 1 is embodied in the shape of a wheel, and consists of two collars 10, between which the fibers of the fiber cable 6 are guided, and of a plurality of knives 4.1 and 4.2, the blades 5.1 and 5.2 of which are directed in the direction of the outer circumference. A channel (or channel assembly) 3 is provided between the collars 10, which is penetrated by the knives 4.1 and 4.2 such that penetrable openings are formed between the knives 4.1 and 4.2. The fibers of the fiber cable 6 wind about the knife carrier 1 by means of the continuous rotation of the knife carrier 1, and are positioned on top of the blades 5.1 of the knives 4.1. The press-on element 2, which in this case is embodied as a roller that rolls off the knife carrier 1, presses the fibers of the fiber cable 6 against the blades 5.1 of the knives 4.1 such that the same are cut and pressed through the channel 3, or through the openings formed between the knives 4.1. Any fibers of the fiber cable 6 that are not cut are gradually wound onto the knife carrier 1 and can also be cut one rotation later at an increased press-on force.

The knives 4.1 and 4.2 are arranged in two groups. The blades 5.1 of the first knife group of the knives 4.1 clamp a cutting surface 7, the blades 5.2 of the second group of the knives 4.2 clamp a further blade surface 8, which has a greater distance to the press-on element 2. This results in the fibers, as illustrated in FIG. 2, being initially cut by the blades 5.1 of the first knife group of the knives 4.1 into long fiber sections, and being pressed in radial direction toward the inside through the openings of the channel 3. Due to the fiber sections continuously being fed from the outside during the course of the cutting process, the same are gradually pressed toward the inside in radial direction by means of the openings of the channel 3 formed between adjacent knives 4.1, until the same are cut by the blades 5.2 in the cutting surface 8 of the second knife group of the knives 4.2.

The height offset of the knives 4.1 and 4.2 of both groups has the advantage that the intermediate spaces between the knives 4.1 are greater such that the fiber sections experience only little friction. In particular, the short fiber sections created by the second cut can be better discharged due to the free space behind the knife 4.1 of the first knife group.

For this purpose the cutting surfaces 7 and 8 may be arranged such that the knives 4.1 and 4.2 partially overlap each other so that the height offset between the knives 4.1 and 4.2 is smaller than a depth of the knives 4.1 of the first group. However, as an alternative it is also possible to embody the height offset at the same depth of the knives 4.1 so that the blades 5.2 of the knives 4.2 are arranged at a smaller or equal diameter as the rear of the outer knives 4.1. In the example embodiment according to FIG. 1 the height offset is embodied smaller between the knives 4.1 and 4.2 than half of the depth of the knives 4.1 of the first knife group.

The size of the height offset resulting between the cutting plane 7 and 8 depends on the available installation space, the size of the knives 4.1 and on the required friction relationships, and represents a compromise that is easily found by the person skilled in the art.

After the cutting operation the fiber sections are conveyed further toward the inside in radial direction, and are transported away in a manner not illustrated herein.

Figure 5:
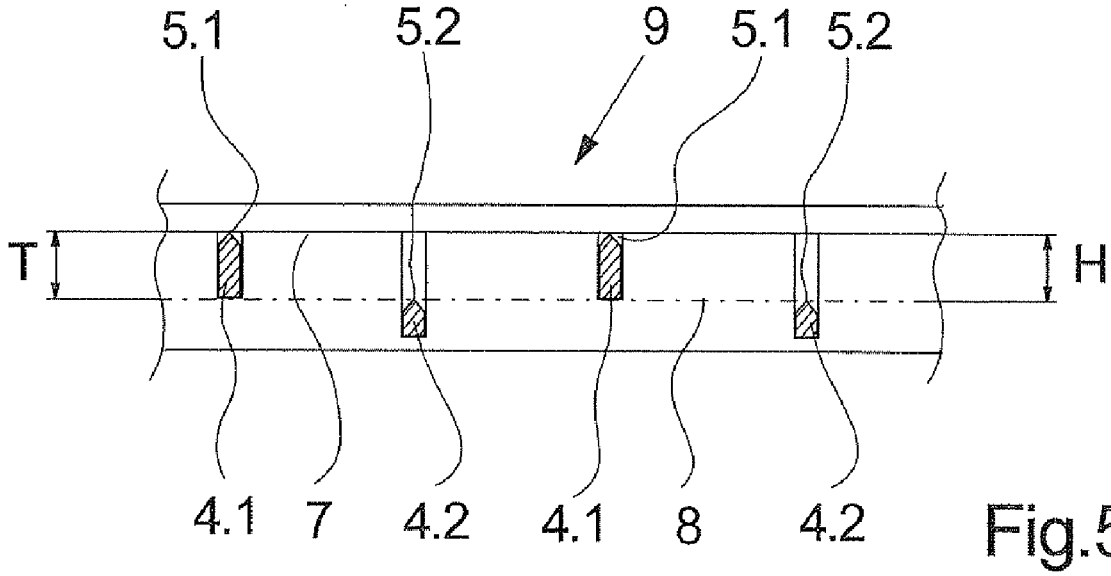
FIG. 5: a schematic cross-sectional view of the example embodiment of FIG. 4 at a cross-section B-B, having different knife arrangements.
Figure 4:
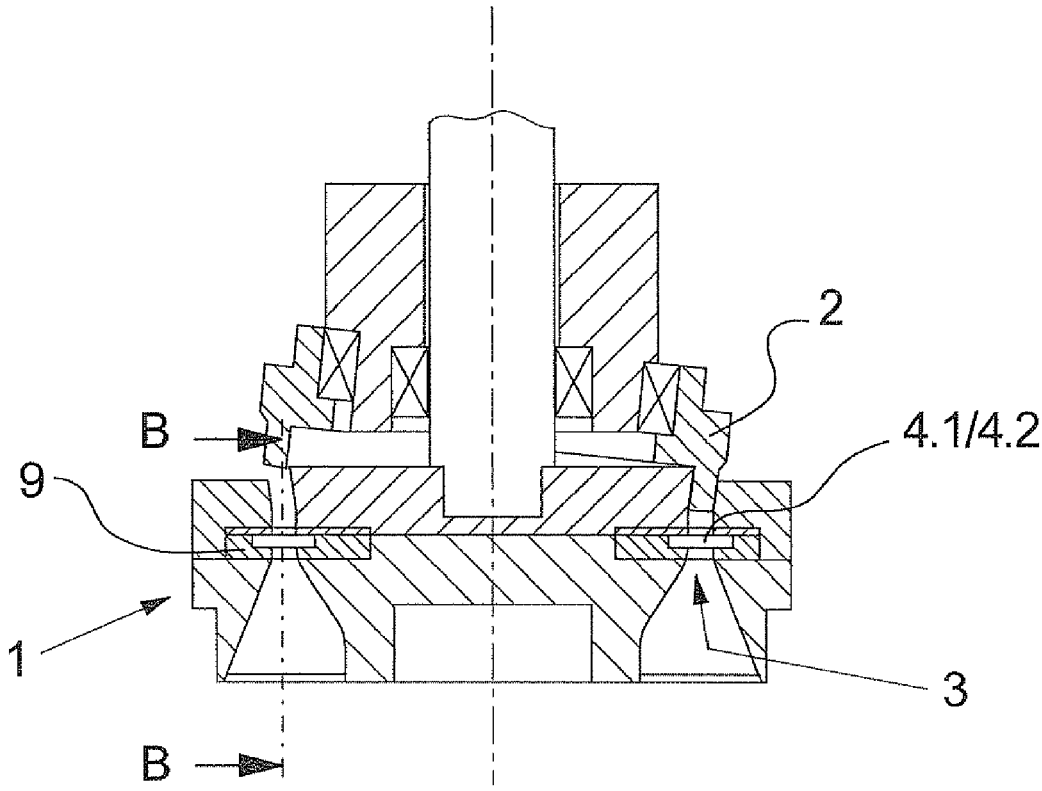

FIG. 4 illustrates a further example embodiment of the cutting device according to the invention. FIG. 5 shows a cross-sectional illustration of the example embodiment having the cross-section B-B illustrated in FIG. 4. The following description applies to both figures, unless express reference is made in the figures.

The example embodiment according to FIGS. 4 and 5 has a rotation symmetric knife carrier 1, which has multiple knives within a channel 3 extending radially in circumferential direction. For this purpose the knives are arranged substantially radially, having blades within the channel 3 that face in axial direction. The knife carrier 1 interacts with a press-on element 2, which is embodied as a rotating press-on ring, and penetrates into the channel 3 at a nose. Such a cutting device is described, for example, in DE 102 42 553, the teachings of which are hereby incorporated by reference in their entirety.

The main difference to the known cutting device is the fact that multiple groups of knives are arranged within the channel 3 in the example embodiment shown in FIG. 4. The knife carrier 1 has a knife holder 9 having two groups of knives 4.1 and 4.2, which are aligned radially. The blades 5.1 and 5.2 of the knives 4.1 and 4.2 face in axial direction toward the side of the press-on element such that a fiber cable guided in the channel 3 is pressed in axial direction against the blades 5.1 of the knives 4. 1. In this case the channel 3 is embodied as an axially parallel annular channel. The fiber cable 6 not illustrated herein is fed to the channel 3 in axial direction, and is pressed against the blades 5.1 and 5.2 of the knives 4.1 and 4.2 by means of the annular press-on element, which is embodied as a rotating cup wheel having a slightly tilted pivoting axis as opposed to the pivoting axis of the knife carrier 1.

Analogous to the cylindrical cutting surfaces 7 and 8 of both knife groups of the knives 4.1 and 4.2 in FIGS. 1 to 3 plane cutting surfaces 7 and 8 are formed in the example embodiment shown by means of both groups of the knives 4.1 and 4.2, which are clamped by means of the blades 5.1 of the knives 4.1 in a first knife plane, or by means of the blades 5.2 of the knives 4.2 of a second knife plane, respectively.

The arrangement of the knives 4.1 and 4.2 is clear particularly from the image shown in FIG. 5. FIG. 5 illustrates a cutout of a cross-sectional illustration of the example embodiment of FIG. 4 at a cross-section B-B of FIG. 4. Two groups of knives 4.1 and 4.2 are successively arranged at a distance to each other at the knife holder 9. The blades 5.1 of the knives 4.1 of the first group form a first cutting surface 7. The blades 5.2 of the knives 4.2 of the second group form a second cutting surface 8. The cutting surface 7 and the cutting surface 8 are offset by a height offset that is set between the knives 4.1 and 4.2 in vertical direction, which in this case is equal to the axial direction of the cutting device. The height offset is denoted by the capital letter H. The height offset H in this example embodiment is selected such that the blades 5.2 of the knives 4.2 end at the base of the knives 4.1. For this purpose the height offset H is embodied equal to a depth of the knives 4.1. The depth of the knives 4.1 is denoted by the capital letter T.

Due to the offset arrangement at the height offset H equal to the depth T, correspondingly large openings are created between the knives 4.2 for the discharge of the fiber sections in the channel. In this manner the fiber sections can be discharged in the channel 3 directly after cutting by the knives 4.2 of the second group.

The function for cutting the fiber cable and the fiber sections in the example embodiment according to FIGS. 4 and 5 is identical to the example embodiment according to FIGS. 1 to 3 so that no further explanations are provided at this point.

In the example embodiments shown the fibers are cut in two steps by means of two knife groups. For this purpose the knives of the knife groups are successively arranged such that a fiber section created by the knives of the first knife group is cut in the center as much as possible by an offset knife of the second knife group. In this manner the longer fiber section is twice as long as the short fiber section of the fibers. However, it is generally also possible to cut a fiber section cut by a first knife group multiple times so that the longer fiber section has triple or four times the length of the shorter fiber section. For this purpose further example embodiments of knife arrangements are illustrated in FIGS. 6 and 7, as the same could be utilized, for example, in the cutting device according to FIG. 4.

Figure 6:
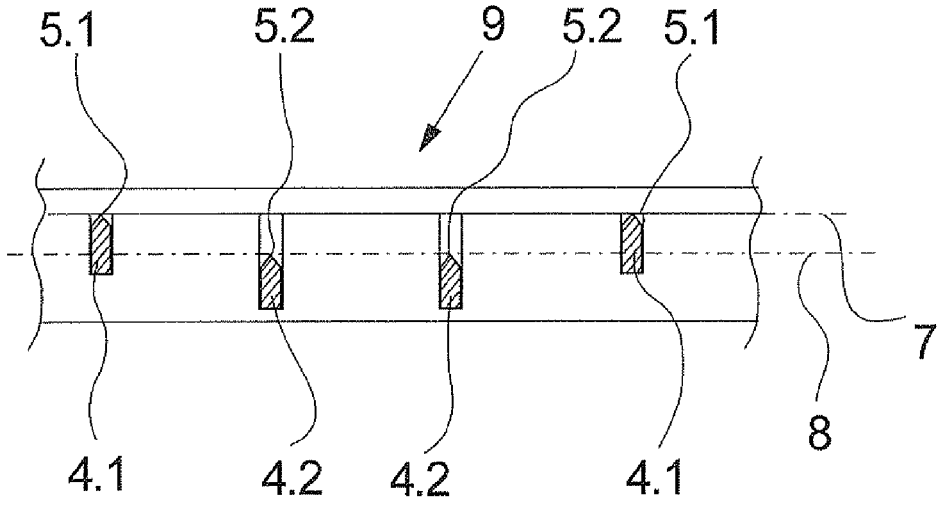
FIGS. 6 and 7: a schematic cross-sectional view of the example embodiment of FIG. 4 at a cross-section B-B having various knife arrangements.

FIG. 6 illustrates a knife holder 9, wherein the knives 4.1 and 4.2 of two knife groups are arranged at an offset to one another. The blades 5.1 of the knives 4.1 form a first cutting surface 7, and the knives 4.2 arranged by a height offset form a second cutting surface 8 with the blades 5.2 thereof. Two knives 4.2 of the second group are arranged between two adjacent knives 4.1 of the first knife group. The knives 4.1 and the knives 4.2 are symmetrical to each other and form an equal distance to each other.

In the example embodiment illustrated in FIG. 6 a fiber of the fiber cable is initially cut into long fiber sections, the length of which is determined by the distances between the knives 4.1 of the first knife group. Subsequently each of the long fiber section guided between two knives 4.1 is cut into three equally short fiber pieces by means of two knives 4.2 of the second group.

Figure 7:
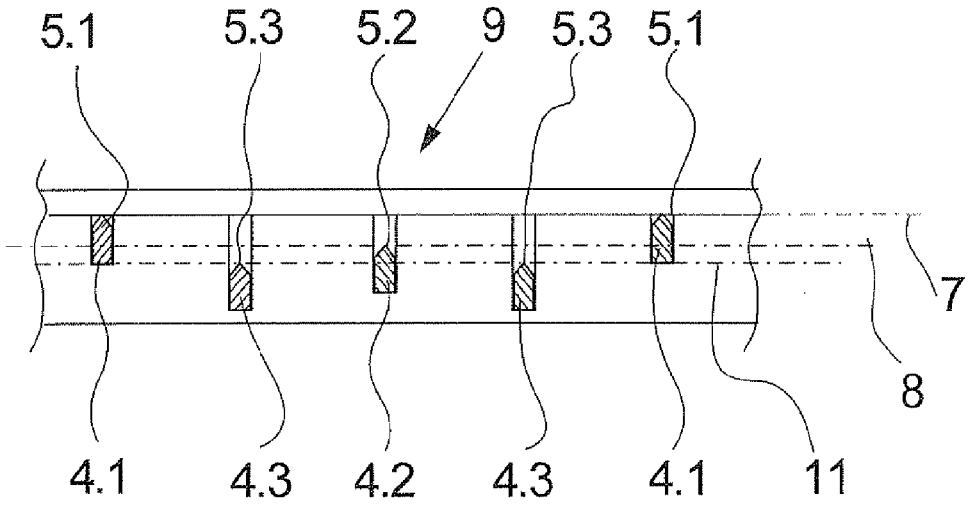

A further possible arrangement of knife groups is shown in FIG. 7 in order to cut the fibers in fiber sections that are as short as possible. In this example embodiment a total of three groups of knives 4.1, 4.2, and 4.3 are arranged on the knife holder 9 at an offset to each other. In this manner the blades 5.1 of the knives 4.1 form a first cutting surface 7, the blades 5.2 of the knives 4.2 form a second cutting surface 8, and the blades 5.3 of the knives 4.3 form a third cutting surface 11. The knives 4.1 and 4.3 are arranged successively on the knife holder, wherein an equal distance is set between the knives 4.1, 4.2, and 4.3. A first height offset is set between the knives 4.1 and the knives 4.2, and a second height offset is set between the knives 4.2 and 4.3 so that the fibers are successively cut into fiber sections in three steps.

The arrangement of the knife groups illustrated in FIGS. 6 and 7 is shown by way of example. Generally, such knife arrangements may also be carried out in the cutting device according to the example embodiment of FIG. 1. Furthermore, it is also possible that the knives are arranged at multiple knife holders in a distributed manner, interacting with each other for cutting the fiber and fiber sections.

LIST OF REFERENCE SYMBOLS

1 knife carrier
2 press-on element
3 channel
4.1 knife
4.2 knife
5.1 blade
5.2 blade
6 fiber cable
7 cutting surface of the first knife group
8 cutting surface of the second knife group
9 knife holder
10 collar
11 cutting surface of the third knife group

What is claimed is:

1. A method for the continuous cutting of fibers fed in the form of a fiber cable into fiber sections, wherein the fiber cable is continuously fed to a cutting device, wherein the cutting device has a plurality of blades having a continuous movement, wherein the fibers are initially separated into longer fiber sections by the cutting device, and wherein the longer fiber sections are then separated into shorter fiber sections by the same cutting device.

2. The method according to claim 1, wherein the fiber sections are created by means of knives having blades that are arranged at an offset to one another.

3. The method according to claim 1, wherein the fiber cable is fed to a first group of knives having blades at a partial loop for cutting the fibers, and is separated into the larger fiber sections by means of pressing the same on.

4. The method according to claim 1, wherein the larger fiber sections between two adjacent blades of the first group of knives are fed to the blades of the next group of knives, and are cut.

5. The method according to claim 1, wherein the fiber sections between two adjacent blades of the second group of knives are discharged.

6. A cutting device for continuously cutting fibers fed in the form of a fiber cable into fiber sections, comprising:

a rotationally driven knife carrier including a plurality of knives;

a channel assembly that is connected to the knife carrier, the channel assembly being penetrated by the knives; and a press-on element for pressing the fiber cable onto the blades of the knives in a press-on direction;

wherein the knives are arranged in at least two groups;

wherein the blades of the knives of the first group have a smaller distance to the press-on element in the press-on direction, than the blades of the knives of the second group;

wherein the fiber cable is continuously fed to a cutting device;

wherein the fibers are initially separated into longer fiber sections by the cutting device; and wherein the longer fiber sections are then separated into shorter fiber sections by the cutting device.

7. The cutting device according to claim 6, wherein one knife of the first group, and one knife of the second group is arranged on the knife carrier.

8. The cutting device according to claim 6, wherein one or multiple knives of the second group are arranged on the knife carrier between adjacent knives of the first group.

9. The cutting device according to claim 6, wherein a height offset in the press-on direction between the knives of the groups to one another corresponds to half of a depth of the knives of the first group.

10. The cutting device according to claim 9, wherein the height offset between the knives of the groups at each other is at least equal to the depth of the knives of the first group.

11. The cutting device according to claim 6, wherein the knives of the knife carrier are arranged substantially axially parallel, wherein the blade is directed toward the outside in a press-on direction that is directed radially toward the inside.

12. The cutting device according to claim 6, wherein the knives of the knife carrier are arranged substantially axially parallel, wherein the blade is directed in axial direction and in an axial press-on direction.

13. The cutting device according to claim 6, wherein the knives of the groups are arranged symmetrically to each other on the knife carrier.

14. A method to continuously cut fibers of a fiber cable into fiber sections, the method comprising:

continuously feeding fiber cable into a cutting device including a plurality of blades which continuously move;

initially separating the fiber cable into longer fiber sections within the cutting device via the plurality of blades which continuously move; and separating the longer fiber sections into shorter fiber sections within the cutting device via the plurality of blades which continuously move.

* * * * *

UNITED STATES PATENT AND TRADEMARK OFFICE

CERTIFICATE OF CORRECTION

PATENT NO. : 7,917,998 B2
APPLICATION NO. : 12/416466
DATED : April 5, 2011
INVENTOR(S) : Herbert Peters It is certified that error appears in the above-identified patent and that said Letters Patent is hereby corrected as shown below:

Title page, item (30) Foreign Application Priority Data change

"Apr. 18, 2008 (DE).....10 2008 019 584"

to

--Apr. 18, 2008 (DE).....10 2008 019 584.7--

Signed and Sealed this
Seventeenth Day of May, 2011

David J. Kappos

David J. Kappos
*Director of the United States Patent and Trademark Office*